US007735692B2

(12) United States Patent
Nelson

(10) Patent No.: US 7,735,692 B2
(45) Date of Patent: Jun. 15, 2010

(54) ROTATING DISPENSER HEAD WITH LOCKING AND VENTING CLOSURE CONNECTOR FOR AN AIR FOAMING PUMP DISPENSER

(75) Inventor: Philip L. Nelson, Wildwood, MO (US)

(73) Assignee: Meadwestvaco Calmar, Inc., Grandview, MO (US)

( * ) Notice: Subject to any disclaimer, the term of this patent is extended or adjusted under 35 U.S.C. 154(b) by 667 days.

(21) Appl. No.: 11/548,118

(22) Filed: Oct. 10, 2006

(65) Prior Publication Data

US 2008/0083783 A1 Apr. 10, 2008

(51) Int. Cl.
*B05B 11/00* (2006.01)
*B05B 7/26* (2006.01)

(52) U.S. Cl. ..... 222/190; 222/153.13; 222/321.7; 222/321.9

(58) Field of Classification Search ..... 222/190, 222/321.7, 321.9, 153.13
See application file for complete search history.

(56) References Cited

U.S. PATENT DOCUMENTS 4,057,176 A * 11/1977 Horvath ..... 222/321.9
5,271,530 A 12/1993 Uehira et al.
5,401,148 A 3/1995 Foster et al.
5,443,569 A 8/1995 Uehira et al.
5,445,288 A * 8/1995 Banks ..... 222/190
5,570,819 A 11/1996 Uehira et al.
5,725,128 A 3/1998 Foster
5,881,925 A * 3/1999 Ando ..... 222/190
6,006,949 A 12/1999 Foster et al.
6,050,457 A * 4/2000 Arnold et al. ..... 222/321.9
6,612,468 B2 * 9/2003 Pritchett et al. ..... 222/190
6,644,516 B1 11/2003 Foster et al.
6,840,408 B1 1/2005 Foster et al.
6,923,346 B2 8/2005 Foster et al.
2004/0069807 A1 * 4/2004 Brouwer et al. ..... 222/175
2007/0045350 A1 * 3/2007 Lin ..... 222/321.9

* cited by examiner

*Primary Examiner*—Kenneth Bomberg

(57) ABSTRACT

A manually operated, vertically reciprocating liquid pump dispenser is removably connectable to a bottle containing liquid and simultaneously pumps liquid from the bottle and air from the exterior environment of the dispenser and mixes the liquid with the air to produce a foam that is dispensed from the dispenser. The dispenser includes a closure connector that provides a mechanism for venting the interior of the bottle to the exterior environment of the dispenser while avoiding leakage of the liquid from the bottle, and also incorporates a mechanism for locking the dispenser to prevent unintended pumping of liquid from the bottle.

10 Claims, 5 Drawing Sheets

ROTATING DISPENSER HEAD WITH LOCKING AND VENTING CLOSURE CONNECTOR FOR AN AIR FOAMING PUMP DISPENSER

BACKGROUND OF THE INVENTION (1) Field of the Invention

The present invention pertains to a manually operated reciprocating liquid pump dispenser that is removably connectable to a bottle containing a liquid. Manual operation of the dispenser simultaneously pumps the liquid from the bottle and pumps air from the exterior environment of the dispenser, mixes the liquid with the air to produce a foam, and dispenses the foam from the dispenser. More specifically, the pump dispenser of the invention includes a closure connector that provides a mechanism for venting the interior of the bottle to the exterior environment of the pump dispenser while avoiding leakage of the liquid from the bottle, and also incorporates a mechanism for locking the pump dispenser to prevent unintended pumping of the liquid from the bottle.

(2) Description of the Related Art

Manually operated, vertically reciprocated pump dispensers are those types of dispensers that are typically oriented vertically in use, and have a plunger at the top of the dispenser that is manually pressed downwardly to dispense the liquid contents of a bottle connected to the dispenser. The typical construction of such a dispenser includes an elongate pump housing and an elongate plunger that is received inside the pump housing for reciprocating movements between charge and discharge positions of the pump plunger in the pump housing.

The pump housing is inserted into the bottle neck opening of the bottle. A closure connector at the top of the pump housing removably secures the pump housing to the bottle neck. A dip tube connected at the bottom of the pump housing extends downwardly into the liquid in the bottle. The pump housing contains a liquid pump chamber and a check valve. The check valve controls the flow of liquid through the dip tube and into the pump chamber, and prevents the reverse flow of liquid.

The pump plunger has a tubular length with a liquid discharge passage extending through the center of the plunger. A liquid piston is mounted on the plunger and is received in the pump chamber for reciprocating movements. A dispensing head is provided at the top of the plunger. The dispensing head has a discharge outlet that communicates with the discharge passage of the plunger. A check valve in the liquid discharge passage controls the flow of liquid from the pump chamber and out through the dispensing head, and prevents the reverse flow of liquid.

A spring is positioned in the pump chamber. The spring biases the plunger upwardly to a charge position of the plunger relative to the pump housing. The upward movement of the plunger moves the piston upwardly in the pump chamber, which creates a vacuum in the pump chamber that draws liquid through the dip tube and into the pump chamber.

The pump plunger is manually depressed downwardly against the bias of the spring to a discharge position of the plunger relative to the pump housing. The downward movement of the plunger moves the piston downwardly in the pump chamber. The downward piston movement forces the liquid in the pump chamber through the liquid discharge passage of the plunger and out of the dispenser through the dispensing head.

In addition to the basic component parts of the manually operated, vertically reciprocated pump dispenser described above, many prior art pump dispensers are provided with a venting feature. The venting feature includes a vent opening that communicates the exterior environment of the dispenser with the interior of the bottle when the pump plunger is reciprocated in the pump housing. Air from the exterior environment of the dispenser is allowed to pass through the vent opening and enter the bottle interior to fill the volume in the bottle interior left vacant by the liquid being dispensed by the operation of the pump. Without such a vent opening, as liquid is dispensed from the bottle, a vacuum would be created in the bottle interior. The vacuum would eventually overcome the vacuum created by the pump piston moving to its charge position in the pump chamber, and prevent the pump from drawing liquid into the pump chamber. The increasing vacuum in the interior of the bottle could also possibly result in the inwardly collapsing of the bottle side walls. To overcome this problem, many prior art manually operated, vertically reciprocated pump dispensers are provided with constructions that allow air to vent into the interior of the bottle connected to the dispenser, while preventing liquid in the bottle from leaking out of the dispenser through the vent feature.

In addition to the above, many prior art manually operated, vertically reciprocated pump dispensers are provided with a locking feature. The locking feature would lock the plunger in its upward charge position relative to the pump housing or its downward discharge position relative to the pump housing. The locking feature would also close the liquid flow path through the pump. The locking feature thus prevents the unintended pumping of liquid from the bottle caused by unintended reciprocating movements of the pump plunger in the pump housing.

All of the above-described features that are often included in the typical construction of a manually operated, vertically reciprocated pump dispenser add to the number of component parts of the dispenser and add to the complexity of the assembly of the dispenser.

Manually operated, vertically reciprocated liquid pump dispensers have been developed that not only pump liquid from a bottle through the dispenser, but also pump air from the exterior environment of the dispenser through the dispenser, mixing the air with the liquid to generate a foam that is dispensed from the dispenser. These types of dispensers not only include all of the component parts of a dispenser required to draw liquid from the bottle connected to the dispenser and pump the liquid from the dispenser, but also include the additional component parts required to draw air from the exterior environment of the dispenser into the dispenser, mix the air with the liquid being pumped through the dispenser to generate the foam, and dispense the foam from the dispenser. Dispensers of this type that pump both liquid and air have even more component parts and an even more complex assembly than dispensers that pump only liquid. To provide a dispenser of this type with a venting feature and a locking feature would even further increase the number of component parts and the complexity of the assembly of the dispenser. To manufacture such a dispenser economically, it is necessary to provide a unique design of the dispenser that reduces the number of separate component parts of the dispenser and simplifies the dispenser construction.

SUMMARY OF THE INVENTION

The manually operated, vertically reciprocating air foaming pump dispenser of the invention provides a unique dispenser construction that includes both liquid and air pumps and also provides a venting features and a locking feature while minimizing the number of component parts and the complexity of the dispenser assembly.

The construction of the pump dispenser of the invention is basically comprised of a pump housing that contains a liquid pump chamber, a closure connector that incorporates the venting feature and the locking feature with an air pump chamber of the dispenser, a pump plunger that is received in the pump housing for reciprocating movements and supports both a liquid pump piston and an air pump piston, and a dispenser head that is mounted on the top of the pump plunger and seals the venting feature. All of the component parts of the dispenser are constructed of a plastic typically used in the construction of dispensers of this type, except for a coil spring and a pair of ball valves that could be constructed of metal or plastic. In the description of the pump dispenser provided herein, terms such as "upward" and "downward" are used to describe the dispenser in a vertically upright orientation shown in the drawing figures. This is the typical orientation of the dispenser when operated, but the dispenser could be operated in other orientations. Therefore, the terms "upward" and "downward," and related terms should not be interpreted as limiting.

The pump housing of the dispenser has a tubular configuration that contains the liquid pump chamber. A top opening in the pump housing provides access to the pump chamber. A flat, annular ring is provided around a top portion of the pump housing. The ring is dimensioned to rest on the top of the neck of the bottle to which the pump dispenser is attached. A vent hole passes through the ring and forms a portion of the vent passage to the bottle interior.

A dip tube extends downwardly from the bottom of the pump housing and communicates the dispenser with liquid in a bottle to which the dispenser is attached. A ball check valve is positioned in the pump housing between the dip tube and pump chamber. The ball valve controls the flow of liquid into the pump chamber, and prevents the reverse flow of liquid.

The closure connector is attached to the top of the pump housing. The connector has a flat, circular base that extends over the top of the pump housing annular ring. A center hole through the base aligns with the top opening of the pump housing. A cylindrical side wall extends downwardly from the outer periphery of the base. The side wall has internal screw threading, a bayonet fitment, or other equivalent means of removably attaching the connector to the neck of the bottle, and thereby removably attaching the dispenser to the bottle. A cylindrical exterior wall extends upwardly from the connector base. A cylindrical air pump chamber wall also extends upwardly from the connector base. The air pump chamber wall is spaced radially inwardly from the exterior wall, thereby defining a cylindrical empty space or void between the air pump chamber wall and the exterior wall. A notch is formed in the bottom of the air pump chamber wall where it joins with the connector base, and a hole passes through the connector base below the notch in the air pump chamber wall. The notch communicates the empty space between the connector exterior wall and the air pump chamber wall with the hole through the connector base, and the hole through the connector base communicates with the hole through the pump housing annular ring. Thus, an air venting passage is provided from the exterior environment of the pump dispenser through the empty space between the connector exterior wall and the air pump chamber wall, through the notch in the air pump chamber wall, through the hole in the connector base, and through the hole in the pump housing annular ring to the interior of the bottle connected to the pump dispenser. A plurality of lock posts are also provided on the closure connector inside the air pump chamber wall. The plurality of posts project upwardly from the connector base and are positioned around the connector center hole.

The pump plunger has a tubular length that extends downwardly through the center hole of the connector base and through the top opening of the pump housing. A liquid discharge passage of the pump dispenser extends through the center of the plunger. The pump plunger is received in the pump housing for reciprocating movements of the pump plunger in the pump housing. The pump plunger is moved downwardly through the pump housing to a discharge position of the pump plunger relative to the pump housing, and is moved upwardly through the pump housing to a charge position of the pump plunger relative to the pump housing.

A ball check valve is positioned in the liquid discharge passage adjacent the top of the plunger. The ball valve controls the flow of liquid from the pump chamber through the plunger, and prevent the reverse flow of liquid.

A liquid piston is mounted to the lower end of the plunger. The liquid piston engages in a sealed, sliding engagement in the liquid pump chamber of the pump housing.

An air piston is also mounted on the plunger above the liquid piston. The air piston engages in a sealed, sliding engagement in the air pump chamber on the closure connector. A center portion of the air piston has a conical configuration that is dimensioned to receive the plurality of lock posts when the air piston reciprocates with the plunger.

A plurality of flanges project radially outwardly from the plunger. The flanges are rotatable with the plunger relative to the pump housing and the closure connector. Rotating the plunger rotates the flanges between locked and unlocked positions of the flanges relative to the lock posts. In the locked positions of the flanges, the flanges are positioned upwardly of the lock posts. In the unlocked positions of the flanges, the flanges are positioned between adjacent lock posts. In the locked positions of the flanges, the lock posts prevent the flanges and the pump plunger from being reciprocated relative to the pump housing. When the flanges are in the unlocked positions the flanges are reciprocated between adjacent lock posts as the pump plunger is reciprocated relative to the pump housing.

A dispensing head is mounted on the top of the pump plunger. The dispensing head contains a spout having an outlet passage that communicates with the liquid discharge passage of the plunger. The dispensing head also has a cylindrical sleeve that extends downwardly into the cylindrical empty space between the closure connector exterior wall and the air pump chamber wall. The thickness of the sleeve increases as it extends downwardly. The dimensions of the dispensing head sleeve cause a downward portion of the sleeve to engage in a sealing engagement between the closure connector exterior wall and the air pump chamber wall when the plunger is moved upward to the charge position of the pump plunger. This seals closed the vent air flow path through the pump dispenser. The dimensions of the dispensing head sleeve also allow the sleeve to disengage from the closure connector exterior wall and the air pump chamber wall when the pump plunger is moved downward to the discharge position of the pump plunger. This opens the air flow path through the pump dispenser.

Thus, the pump dispenser of the invention comprises both a liquid pump and an air pump that mix liquid and air pumped through the dispenser to create a foam dispensed by the dispenser. In addition, the novel construction of the pump dispenser incorporates the closure connector with a venting feature and a lock feature of the dispenser, thereby reducing the number of component parts of the dispenser and simplifying the dispenser construction.

DESCRIPTION OF THE DRAWING FIGURES

Further features of the air foaming pump dispenser of the invention are set forth in the following detailed description of the pump dispenser and in the drawing figures of the pump dispenser.

DETAILED DESCRIPTION OF THE PREFERRED EMBODIMENT

Figure 2:
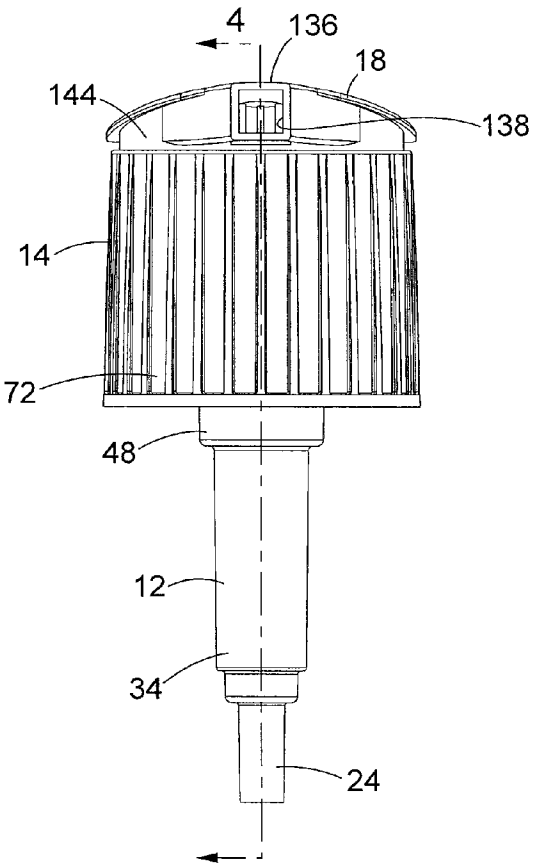
FIG. 2 is a front elevation view of the air foaming pump dispenser with the pump plunger in the downward, discharge position of the pump plunger relative to the pump housing.
Figure 1:
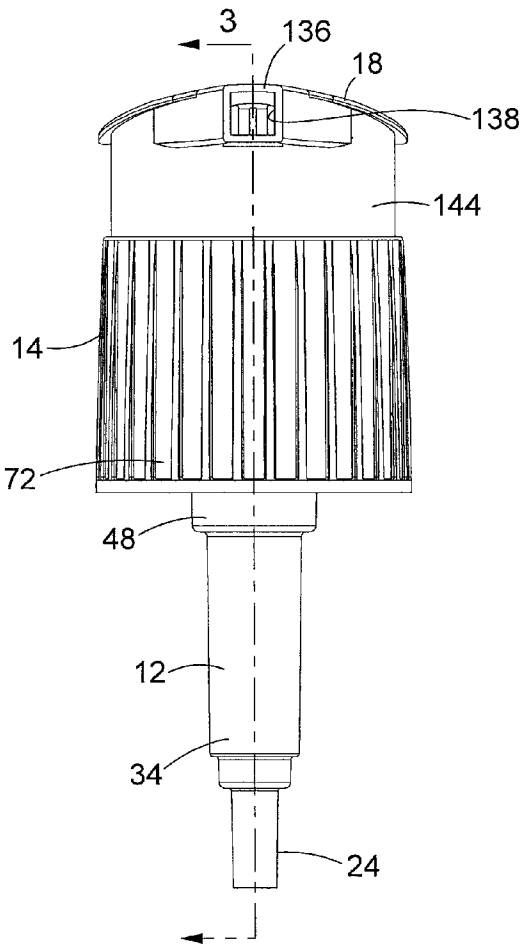
FIG. 1 is a front elevation view of the air foaming pump dispenser with the pump plunger in the upward, charge position of the pump plunger relative to the pump housing.

The basic component parts of the pump dispenser that comprise the novel features of the invention are the pump housing 12, the closure connector 14, the pump plunger 16 and the dispenser head 18. These four basic component parts, as well as most of the other component parts of the dispenser to be described, are constructed of a plastic material typically used in the construction of pump dispensers of this type. The exceptions are the coil spring of the dispenser and a pair of ball valves of the dispenser, which could be constructed of plastic, but are usually constructed of metal.

The pump housing 12 has a tubular length with a hollow center bore having a center axis 22. The length of the pump housing 12 extends from a dip tube connector 24 at the bottom of the pump housing to an opposite top end 28 of the pump housing that surrounds a top opening into the pump housing. The dip tube connector 24 connects to a dip tube (not shown) that extends into the interior of a bottle, the neck and shoulder of which are represented by dashed lines 26 in FIG. 3. The pump housing 12 contains a liquid pump chamber 32 having a cylindrical liquid pump chamber wall 34. A valve seat 36 is provided at the bottom of the pump housing 12 between the dip tube connector 24 and the liquid pump chamber 32. The valve seat 36 supports a ball valve 38. The ball valve 38 controls the flow of liquid through the dip tube and the dip tube connector 24 into the liquid pump chamber 32, and prevents the reverse flow of liquid. A sealing plug retainer 44 extends axially upwardly from the bottom of the liquid pump chamber 32. The sealing plug retainer 42 retains an elongate stem 44 of a sealing plug 46 in the pump housing 12. The engagement of the retainer 42 with the stem 44 allows for some limited axial movement of the sealing plug 46 in the pump housing 12. A radially enlarged portion 48 of the pump housing 12 extends axially upwardly from the liquid pump chamber wall 34. This portion 48 of the housing extends upwardly to the top end 28 of the pump housing surrounding the top opening. An annular lip 52 is formed on the exterior surface of the pump housing 12 around the top opening. Spaced below the annular lip 52 is a flat annular ring 54 that projects radially outwardly from the pump housing 12. A circular trough 56 is formed into the top surface of the annular ring 54. The trough 56 functions as a portion of the air vent flow path through the pump dispenser. A vent hole 58 (shown in FIG. 4) passes through the trough 56 and also functions as a portion of the air vent path. The vent hole 58 is positioned to communicate the interior volume of the annular ring trough 56 with the interior of the bottle when the pump housing 12 is positioned in the bottle neck 26.

The closure connector 14 has a general cylindrical configuration that is coaxial with the pump housing 12. A center tubular stem 62 of the connector 14 is inserted into the opening at the pump housing top end 28. A circular rim 64 projects inwardly from the interior of the stem 62. An annular shoulder 66 of the connector extends over the pump housing top 28 and downwardly over the pump housing annular lip 52 securing the closure connector 14 to the pump housing 12. A flat circular base 68 extends radially outwardly from the closure connector shoulder 66. A cylindrical connector side wall 72 extends axially downwardly from the outer peripheral edge of the connector base 68. The side wall 72 has internal screw threading 74 that is used to removably attach the pump dispenser to the neck of a bottle. Other equivalent connectors, for example a bayonet connector, could be used. A cylindrical exterior wall 76 extends axially upwardly from the outer peripheral edge of the connector base 68 and upwardly from the connector side wall 72. A cylindrical air pump chamber wall 78 extends upwardly from the closure connector base 68 at a position spaced radially inwardly from the exterior wall 76. The radial spacing between the exterior wall 76 and the air pump chamber wall 78 defines a cylindrical empty space or void 82 that extends axially upwardly between the two walls from the closure connector base 68. At the bottom of the air pump chamber wall 78 where it joins with the closure connector base 68, a portion of the wall surface is recessed 84 forming a notch in the wall. Just below the recessed wall notch 84, a vent hole 86 passes through the closure connector base 68. The vent hole 86 communicates with the interior of the trough 56 formed in the top surface of the pump housing annular ring 54. Thus, together the empty space 82 between the closure connector exterior wall 76 and the air pump chamber wall 78, the recessed surface notch 84, the closure connector vent hole 86, the interior of the pump housing trough 56 and the pump housing vent hole 58 form a venting air flow path from the exterior environment of the pump dispenser to the interior of the bottle 26 connected to the pump dispenser. The connector 14 also includes a pair of lock posts 92 that extend axially upwardly from the closure connector shoulder 66 to top distal end surfaces 94 of the posts. The posts 92 are circumferentially spaced from each other by gaps 96 between the pair of posts. Each post 92 has a limit tab 98 on its top distal end surface 94.

Figure 3:
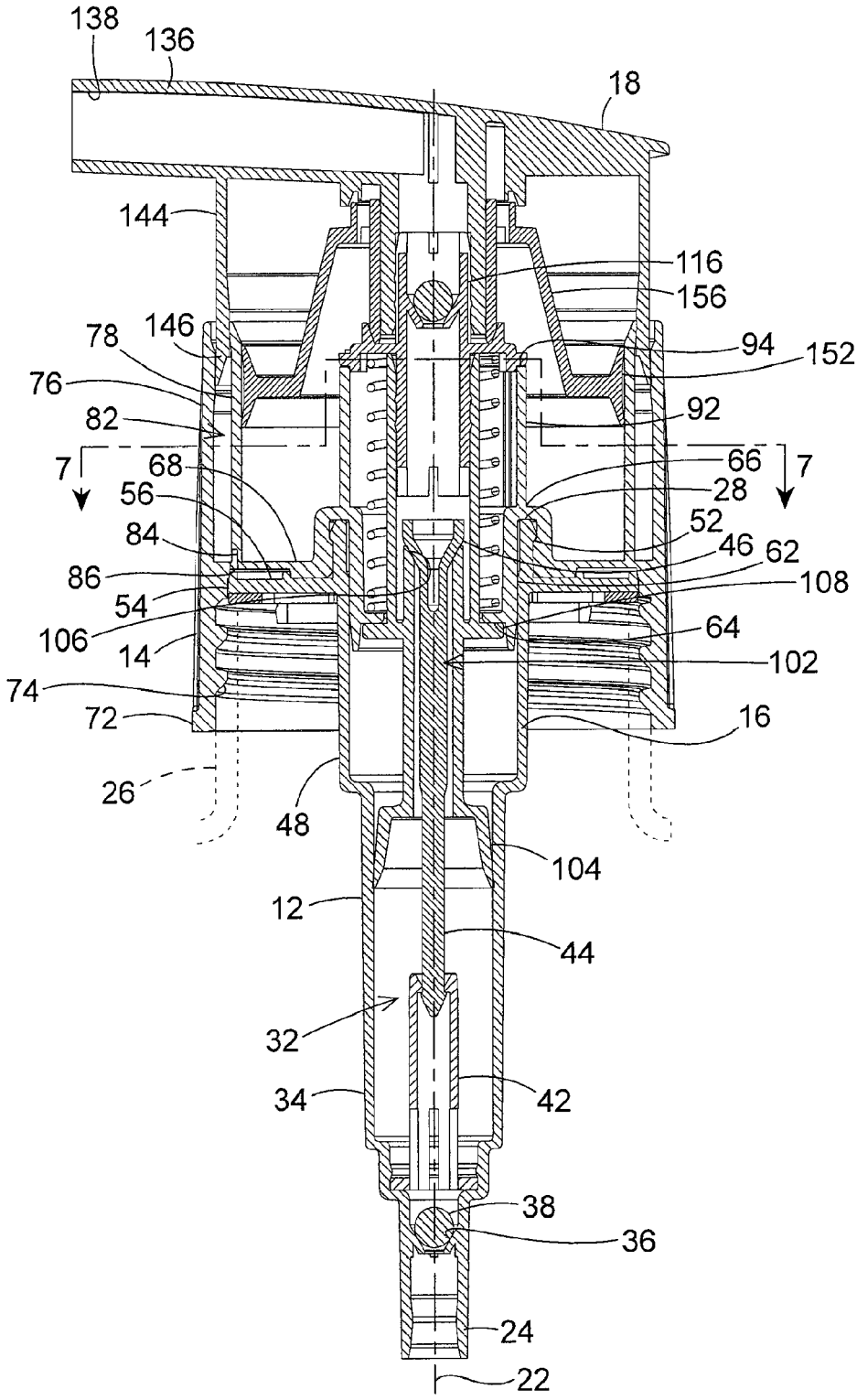
FIG. 3 is a side sectioned view of the air foaming pump dispenser along the line 3-3 of FIG. 1.
Figure 4:
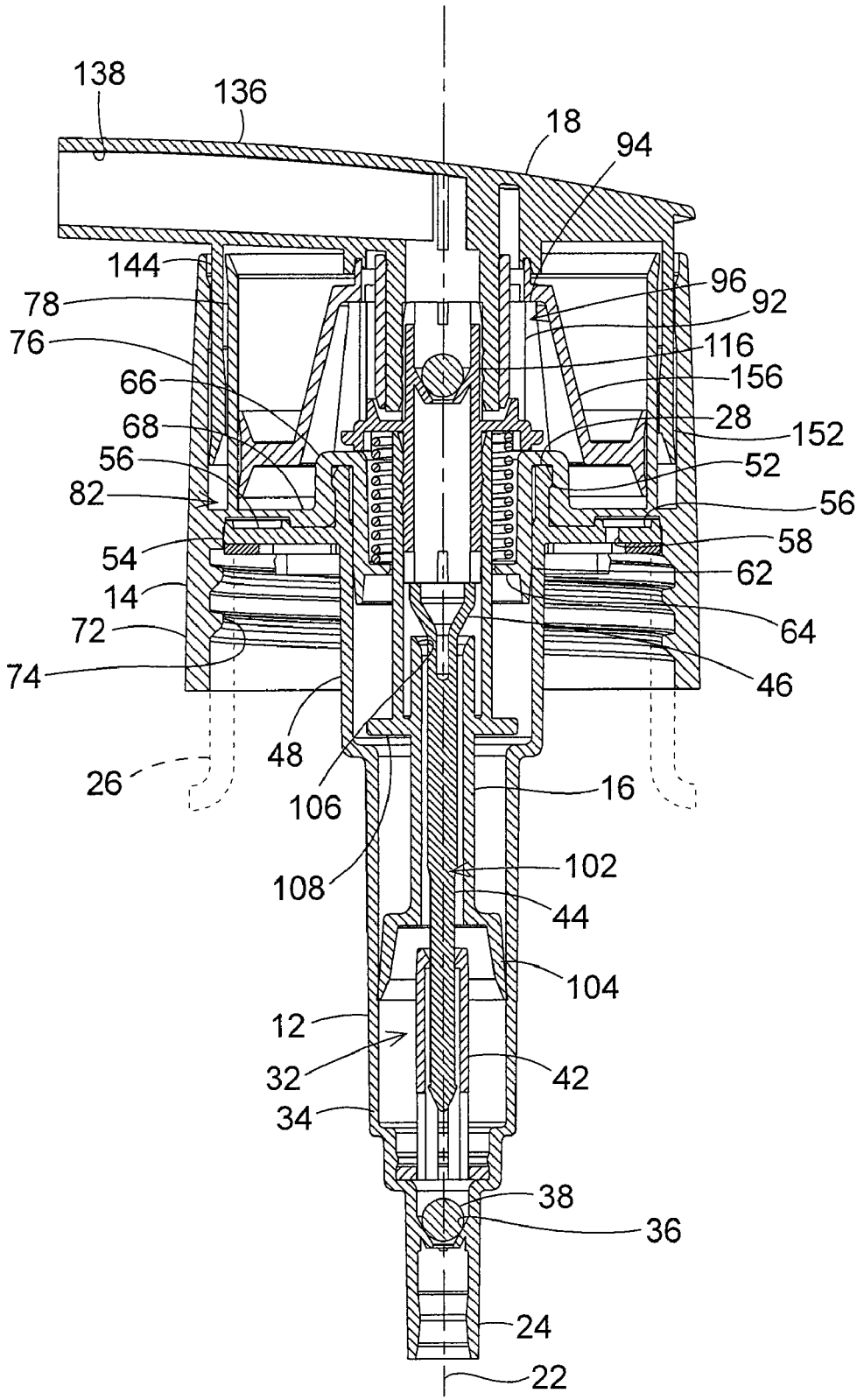
FIG. 4 is a side sectioned view of the air foaming pump dispenser along the line 4-4 of FIG. 2.
Figure 5:
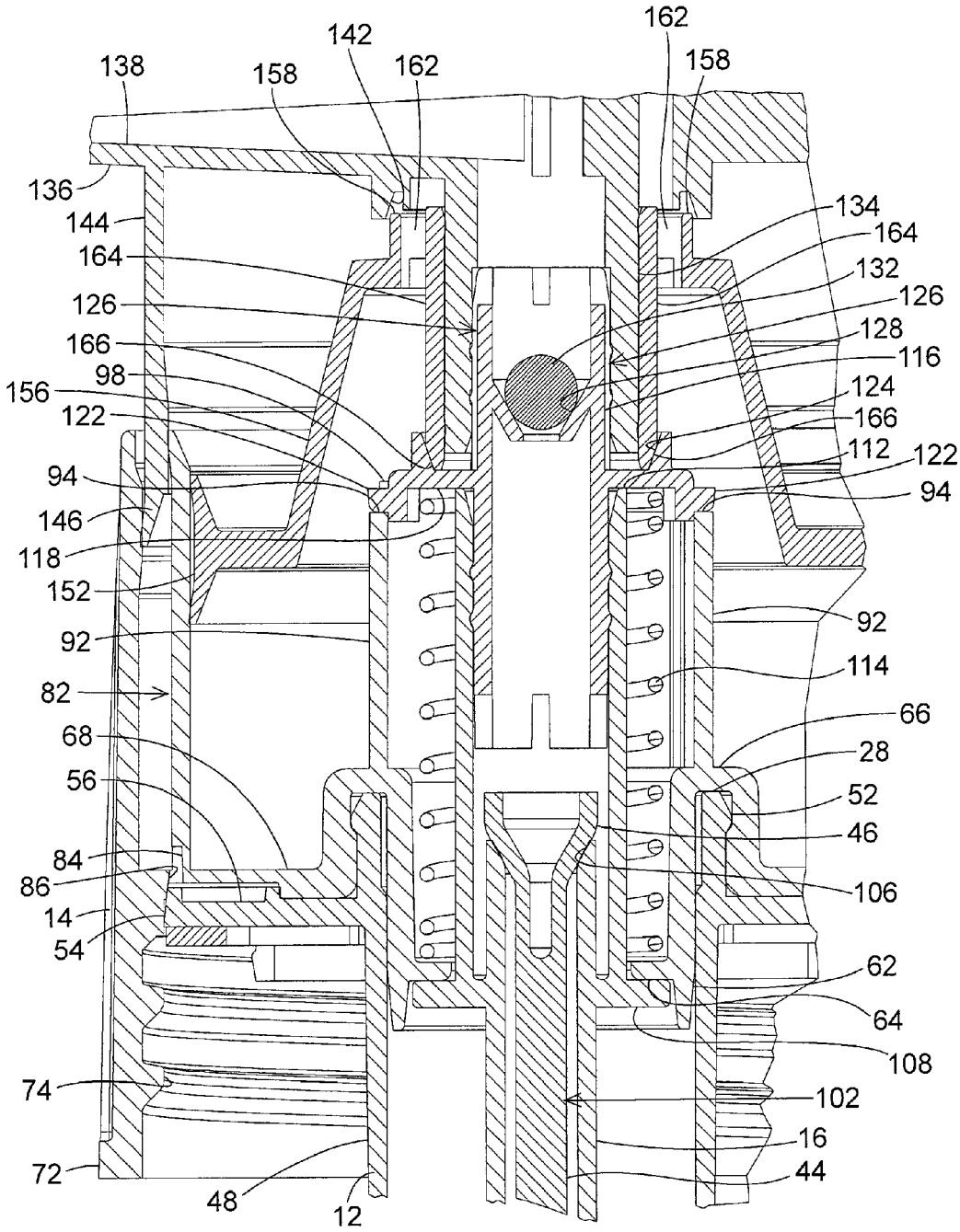
FIG. 5 is an enlarged partial view of FIG. 3.

The pump plunger 16 is mounted in the interior of the pump housing 12 for reciprocating movements between an upward, first charge position of the pump plunger 16 relative to the pump housing 12 shown in FIG. 3, and a downward second discharge position of the pump plunger 16 relative to the pump housing 12 shown in FIG. 4. The pump plunger 16 is also rotatable in the pump housing 12. The pump plunger 16 has an elongate tubular length with a center bore 102 that is coaxial with the center axis 22 of the pump housing. The plunger center bore 102 forms a liquid discharge passage through the pump plunger. A liquid piston 104 is formed at the bottom end of the pump plunger 16. The liquid piston 104 engages in a sliding sealing engagement with the liquid pump chamber wall 34. A sealing plug seat 106 is formed on an intermediate portion of the pump plunger 16. The sealing plug seat 106 is positioned to engage in a sealing engagement with the sealing plug 46 when the pump plunger 16 is moved to its upward, charge position relative to the pump housing 12. An annular retainer ring 108 extends radially outwardly from the pump plunger 16 just below the sealing ring 106 and below the interior rim 64 of the closure connector 14. The engagement of the pump plunger retainer ring 108 with the closure connector rim 64 prevents the pump plunger 16 from being removed from the pump housing 12, and positions the pump plunger 16 in the charge position relative to the pump housing 12. From the retainer ring 108, the pump plunger 16 extends axially upwardly to a top end 112 of the plunger that surrounds a top opening of the plunger.

A coil spring 114 is positioned over the pump plunger 16 and engages on top of the closure connector interior rim 64. The spring 114 biases the pump plunger 16 toward its upward, first charge position relative to the pump housing 12.

A tubular spring holder 116 is inserted into the top end 112 of the pump plunger 12 and is held firmly in the plunger. The spring holder 116 has an annular ring 118 that projects radially outwardly from the spring holder 116 and engages against the top end 112 of the plunger and the top of the coil spring 114. The coil spring 114 acts against the spring holder ring 118 in biasing the pump plunger 16 upwardly to the first, charge position of the plunger 16 relative to the pump housing 12. A pair of lock flanges 122 extend radially outwardly from the spring holder ring 118. The lock flanges 122 extend radially outwardly over and engage against the lock post distal end surfaces 94 in a first rotated position of the pump plunger 16 relative to the pump housing 12, and extend radially outwardly over the gaps 96 between the pair of lock posts 92 in a second rotated position of the pump plunger 16 relative to the pump housing 12. When rotated to the first, locked position, the lock flanges 122 engage against the sides of the limit tabs 98 at the top end surfaces 94 of the lock posts to prevent further rotation of the flanges 122 relative to the lock posts 92. In the first, locked position, the engagement of the flanges 122 with the lock post distal ends 94 prevents the plunger 16 from being reciprocated relative to the pump housing 12 when manually depressed toward the housing. To unlock the pump plunger 16, the plunger must be rotated in a counter-clockwise direction relative to the pump housing 12 to axially align the lock flanges 122 with the gaps 96 between the lock posts 92. When the flanges 122 are rotated to the second, unlocked position where the flanges 122 are axially aligned with the gaps 96, the pump plunger 16 can be manually pressed downwardly into the pump housing 12 and the flanges 122 will move axially through the gaps 96. This allows the pump plunger 16 to be reciprocated in the pump housing 12. Above the lock flanges 122, an air seal ring 124 projects axially upwardly from the top of the spring holder ring 118. Radially inside the air seal ring 124, a plurality of air path grooves 126 are formed in the exterior surface of the spring holder 116. The grooves 126 extend axially upwardly from the annular ring 118 to the top end of the spring holder 116. A valve seat 128 is provided inside the tubular spring holder 116 adjacent the top end of the spring holder. A ball valve 132 is positioned on the valve seat 128. The ball valve 132 controls the flow of fluid upwardly through the spring holder 116 as part of the liquid discharge passage 102 of the pump plunger, and prevents the reverse flow of liquid.

The dispenser head 18 is mounted on the pump plunger 16 by being mounted onto the top end of the spring holder 116. The dispenser head 18 has a center tube 134 inside the dispenser head that is press fit over the top end of the spring holder 116. The engagement of the dispenser head center tube 134 with the spring holder 116 securely holds the dispenser head to the pump plunger 16. The air path grooves 126 in the spring holder 116 provide an air path between the spring holder 116 and the dispenser head center tube 134. A discharge nozzle 136 projects radially outwardly from the dispenser head center tube 134, and an outlet passage 138 in the discharge nozzle 136 communicates with the interior of the center tube 134 and forms a portion of the discharge passage of the pump dispenser. A circular air seal rim 142 is formed in an interior surface of the dispenser head 18 and extends around the dispenser head center tube 134. A cylindrical sleeve 144 extends axially downwardly from the dispenser head 18 and is spaced radially outwardly from the center tube 134 and the air seal rim 142. As the cylindrical sleeve 144 extends downwardly from the dispenser head 18, the thickness of the sleeve 144 increases as it approaches a bottom portion 146 of the sleeve. The thickness of the sleeve bottom portion 146 is dimensioned to engage in sealing engagement between the closure connector exterior wall 76 and the closure connector air pump chamber wall 78 when the pump plunger 16 is in the upward, first charge position relative to the pump housing 12. This engagement closes the air vent flow path through the empty space 82 between the closure connector exterior wall 76 and the air pump chamber wall 78, and prevents liquid from leaking from the bottle through the pump housing vent hole 58, the pump housing trough 56, the closure connector vent hole 86, the air pump chamber wall notch 84, and the empty space 82 between the exterior wall 76 and the air pump chamber wall 78 to the exterior of the dispenser.

An air pump piston 152 is mounted on the pump plunger 16 and engages in a sliding sealing engagement in the air pump chamber wall 78. The air piston 152 has a conically shaped center portion 156 that extends from the outer sealing portion of the air piston 152 radially inwardly toward the pump plunger 16. The conical shaped portion 156 of the air piston receives the lock posts 92 on the closure connector 14 when the pump plunger 16 is moved downwardly to the second, discharge position of the pump plunger 16 relative to the pump housing 12. A cylindrical upper end 158 of the air piston conical portion 156 is dimensioned to engage in a sealing engagement in the air seal rim 142 of the dispenser head 18. The conical portion upper end 158 is joined by a plurality of radial spokes 162 to a center tubular column 164 of the air piston. The spacings between the radial spokes 162 provide air flow paths between the air piston upper end 158 and the air piston center column 164. The air piston column 164 is mounted for limited axial sliding movement on the dispenser head center tube 134. When the air piston column 164 moves downwardly relative to the dispenser head center tube 134, a bottom annular edge 166 of the column engages in a sealing engagement inside the spring holder air seal ring 124. This closes an air flow path from the interior of the air pump chamber inside the air pump chamber wall 78 through the air path grooves 126 between the spring holder 116 and the dispenser head center tube 134 to the dispenser head outlet passage 138. The downward movement of the air piston 152 on the dispenser head center tube 134 causes the upper end 158 of the air piston conical portion 156 to disengage from the air seal rim 142 of the dispenser head. This opens an air flow path from the exterior of the dispenser head through the spacing between the dispenser head sealing rim 142 and the air piston upper end 158 allowing air from the exterior environment of the dispenser pump to enter the air pump chamber inside the air pump chamber wall 78.

In use of the air foaming pump dispenser of the invention, with the dispenser initially in the locked position shown in FIG. 3, the pump plunger 16 is in the first, charge position relative to the pump housing 12. With the pump plunger 16 moved upwardly, the bottom portion 146 of the dispenser head sleeve 144 engages in sealing engagement between the closure connector exterior wall 76 and the air pump chamber wall 78. This closes the venting air flow path from the exterior environment of the dispenser through the cylindrical spacing 82 between the closure connector exterior wall 76 and the air pump chamber wall 78, the recessed notch 84 in the air pump chamber wall, the closure connector vent hole 86, the pump housing annular ring trough 56, and the pump housing vent hole 58 to the interior of the bottle 26 connected to the dispenser. This also prevents the unintended leakage of liquid from the container 26 through the air vent flow path to the exterior of a dispenser.

Figure 6:
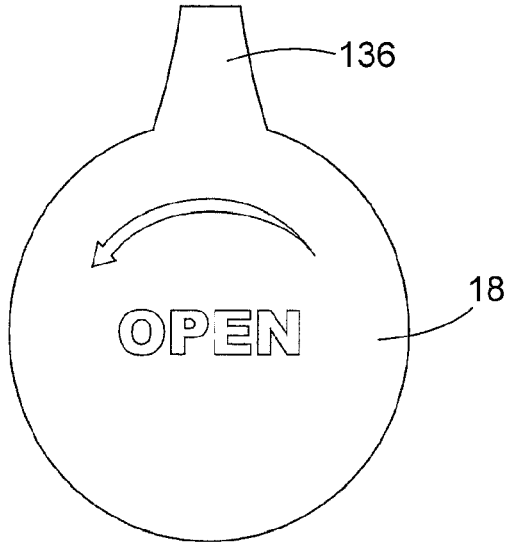
FIG. 6 is a top view of the dispensing head.
Figure 7:
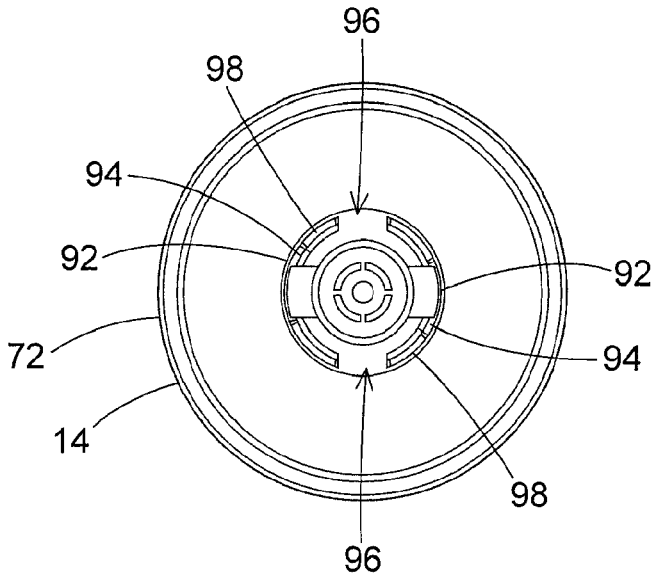
FIG. 7 is a top sectioned view along the line 7-7 of FIG. 3.

With the pump plunger 16 turned clockwise so that the lock flanges 122 on the spring holder 16 engage against the limit tabs 98 on the lock post 92, the positioning of the lock flanges 122 axially above the lock post distal end surfaces 94 prevents the pump plunger 16 from being pushed downwardly and reciprocated relative to the pump housing 12. To reciprocate the pump plunger 16 relative to the pump housing 12, the plunger must first be rotated in a counter-clockwise direction as indicated by the indicia on the top surface of the dispenser head 18 shown in FIG. 6. The pump plunger 12 is rotated counter-clockwise to align the lock flanges 122 on the spring holder 116 with the gaps 96 between the lock post 92. With the lock flanges 122 axially aligned with the gaps 96, the pump plunger 16 can now be manually pushed downwardly into the pump housing 12 to operate the liquid pump and air pump of the dispenser.

As the pump plunger 16 is moved downwardly into the pump housing 12, the lock flanges 122 move axially downwardly through the gaps 96. Additionally, the bottom portion 146 of the dispenser head sleeve 144 disengages from a sealing engagement between the closure connector exterior wall 76 and the air pump chamber wall 78 and moves axially downwardly through the spacing 82 between these two walls. This opens the air vent flow path through the spacing 82 between the exterior wall 76 and the air pump chamber wall 78, through the notch 84 in the air pump chamber wall, through the vent hole 86 in the closure connector 14, through the annular ring trough 56 on the pump housing annular ring 54, and through the vent hole 58 in the pump housing annular ring 54 to the interior of the bottle 26 connected to the dispenser. This vents the interior of the bottle to the exterior environment of the dispenser. In addition, with the bottom portion 146 of the dispenser head sleeve 144 disengaging from the closure connector exterior wall 76 and the air pump chamber wall 78, an air flow path is established through the cylindrical spacing 82 between the exterior wall 76 and the air pump chamber wall 78 and through the spacing between the dispenser head air seal rim 142 and the air pump piston upper end 158 providing air into the air pump chamber surrounded by the air pump chamber wall 78. This air flow path exists for the short period of time before the air piston 152 moves upwardly relative to the dispenser head center tube 134 and the air piston upper end 158 engages in a sealing engagement with the dispenser head air seal rim 142. Simultaneously, the bottom edge 166 of the air pump piston tubular column 164 disengages from the air seal ring 124 of the spring holder 116. This opens an air flow path from the air pump chamber through the grooves 126 in the spring holder 116 to the dispenser head outlet passage 134. Further downward movement of the pump plunger 16 into the pump housing 12 causes downward movement of the air piston 152 in the air pump chamber surrounded by the air pump chamber wall 78, which causes air to be forced from the air pump chamber through the spring holder grooves 126 to the dispenser head outlet passage 138.

Additionally, as the pump plunger 16 moves downward through the pump housing 12, liquid in the liquid pump chamber 32 is pumped out of the chamber by the downward movement of the liquid piston 104 through the liquid pump chamber. The liquid is forced upwardly through the pump plunger liquid discharge passage 102 and mixes with the air pumped from the air pump chamber, generating a foam. The foam is dispensed through the dispenser head outlet passage 138 from the dispenser.

After the pump plunger 16 has been moved downwardly to its second, discharge position relative to the pump housing 12 shown in FIG. 4, the manual pressure on the pump plunger 16 is removed and the coil spring 114 pushes the pump plunger 16 upwardly in the pump housing 12. The spring pushes the plunger 16 upwardly in the housing 12 to the first, charge position of the pump plunger 16 relative to the pump housing 12 shown in FIG. 3. This causes the liquid piston 104 to move upwardly through the liquid pump chamber 32 drawing liquid into the liquid pump chamber, and causes the air piston 152 to first be stationary as the plunger moves upwardly and the dispenser head air seal rim 142 disengages from the air piston upper end 158, and then moves upwardly with the plunger through the air pump chamber surrounded by the air pump chamber wall 78 drawing air into the air pump chamber. With the pump plunger 16 in its first, charge position relative to the pump housing 12 shown in FIG. 3, the plunger is ready for additional manual reciprocating movements relative to the pump housing 12, or is in position to be rotated clockwise relative to the pump housing 12 back to the lock position of the plunger 16.

As described above, the pump dispenser of the invention comprises both a liquid pump and an air pump that mix liquid and air pumped through the dispenser to create a foam dispensed by the dispenser. In addition, the novel construction of the pump dispenser incorporates the closure connector with a venting feature and a lock feature of the dispenser, thereby reducing the number of component parts of the dispenser and simplifying the dispenser construction.

Although the air foaming pump dispenser of the invention has been described above by reference to a specific embodiment shown in the drawing figures, it should be understood that modifications and variations could be made to the air foaming pump dispenser without departing from the intended scope of the following claims.

The invention claimed is:

1. A pump dispenser that is connectable to a bottle and is manually operated to pump liquid from the bottle, the pump dispenser comprising:

a pump plunger having a tubular length with a center axis that defines mutually perpendicular axial and radial directions relative to the pump dispenser, the pump plunger having a discharge passage that extends axially through the pump plunger;

a piston on the pump plunger;

a housing receiving the pump plunger for reciprocating movements of the pump plunger between a first charge position and a second discharge position of the pump plunger relative to the housing;

an annular ring projecting radially outwardly from the housing;

a circular trough formed in a top surface of the annular ring;

a vent hole in communication with the circular trough and an interior volume of the bottle;

a closure on the housing, the closure being positioned on the housing to close an opening on the bottle that receives the housing when connecting the pump dispenser to the bottle;

a cylindrical pump chamber wall extending axially from the closure and extending around the piston, the pump chamber wall defining a pump chamber with an interior volume containing the piston, the pump chamber wall having radially opposite exterior and interior surfaces and the piston engaging in sliding sealing engagement with the pump chamber wall interior surface;

a cylindrical exterior wall extending axially from the closure over the pump chamber wall exterior surface and extending around the pump chamber wall exterior surface, the exterior wall defining a cylindrical empty space radially between the pump chamber wall and the exterior wall; and, a vent passage extending through the closure and axially between the pump chamber wall and the exterior wall and in communication with the circular trough.

2. The pump dispenser of claim 1, further comprising:

the piston being an air piston;

a liquid piston on the pump plunger, the liquid piston being axially spaced from the air piston;

the pump chamber being an air pump chamber, the housing having a liquid pump chamber with an interior volume containing the liquid piston for reciprocating movements of the liquid piston in the liquid pump chamber in response to reciprocating movements of the pump plunger between the first charge and second discharge positions of the pump plunger relative to the housing, the liquid pump chamber having a cylindrical wall that engages in sealing engagement around the liquid piston.

3. The pump dispenser of claim 1, further comprising:

a discharge nozzle on the pump plunger, the discharge nozzle having an outlet passage that communicates with the pump plunger discharge passage, the discharge nozzle moving with the pump plunger on the reciprocating movements of the pump plunger, and the discharge nozzle having a sleeve that extends axially into the cylindrical empty space between the cylindrical pump chamber wall and the cylindrical exterior wall and moves axially through the cylindrical empty space on the reciprocating movements of the pump plunger.

4. The pump dispenser of claim 3, further comprising:

the sleeve moving axially between said first charge position and said second discharge position of the sleeve relative to the cylindrical exterior wall and the cylindrical pump chamber wall, and the sleeve engages against the cylindrical exterior wall in the charge position of the sleeve and disengages from the cylindrical exterior wall in the discharge position of the sleeve.

5. The pump dispenser of claim 1, further comprising:

the vent passage being separated from communicating with the pump chamber interior volume by the cylindrical pump chamber wall.

6. The pump dispenser of claim 5, further comprising:

a discharge nozzle on the pump plunger, the discharge nozzle having an outlet passage that communicates with the pump plunger discharge passage, the discharge nozzle moving with the pump plunger on the reciprocating movements of the pump plunger relative to the housing, and the discharge nozzle having a sleeve that extends axially into the cylindrical empty space between the cylindrical pump chamber wall and the cylindrical exterior wall and moves axially through the cylindrical empty space on the reciprocating movements of the pump plunger relative to the housing.

7. The pump dispenser of claim 6, further comprising:

the sleeve moving axially between said first charge position and said second discharge position of the sleeve relative to the housing, and the sleeve engages against the cylindrical exterior wall in the first charge position of the sleeve and disengages from the cylindrical exterior wall in the second discharge position of the sleeve.

8. The pump dispenser of claim 1, further comprising:

a post on the housing, the post extending axially along a portion of the pump plunger to a distal end of the post; and, a flange on the pump plunger, the flange extending radially from the pump plunger, and the flange being rotatable about the pump plunger center axis between a locked position of the flange where the flange is axially aligned with the post distal end and engages against the post distal end to prevent the pump plunger from moving from the first charge position of the pump plunger to the second discharge position of the pump plunger, and an unlocked position of the flange where the flange is not axially aligned with the post distal end and moves axially adjacent the post when the pump plunger is moved from the first charge position of the pump plunger to the second discharge position of the pump plunger.

9. The pump dispenser of claim 8, further comprising:

the post extending axially from the closure.

10. The pump dispenser of claim 9, further comprising:

the post being positioned radially inside the cylindrical pump chamber wall.

* * * * *